US010988943B2

(12) United States Patent
Peterson

(10) Patent No.: US 10,988,943 B2
(45) Date of Patent: Apr. 27, 2021

(54) DECK DRAINAGE SYSTEMS

(71) Applicant: Jim Peterson, Littleton, CO (US)

(72) Inventor: Jim Peterson, Littleton, CO (US)

( * ) Notice: Subject to any disclaimer, the term of this patent is extended or adjusted under 35 U.S.C. 154(b) by 0 days.

(21) Appl. No.: 16/820,343

(22) Filed: Mar. 16, 2020

(65) Prior Publication Data

US 2020/0354975 A1 Nov. 12, 2020

Related U.S. Application Data

(63) Continuation of application No. 15/697,124, filed on Sep. 6, 2017, now Pat. No. 10,590,662.

(60) Provisional application No. 62/384,034, filed on Sep. 6, 2016.

(51) Int. Cl.

| | |
|---|---|
| ***E04B 1/62*** | (2006.01) |
| ***E04F 17/00*** | (2006.01) |
| ***E04B 1/00*** | (2006.01) |
| ***E04F 15/02*** | (2006.01) |

(52) U.S. Cl.

CPC ..... *E04F 17/00* (2013.01); *E04B 1/003* (2013.01); *E04F 15/02183* (2013.01)

(58) Field of Classification Search

CPC .... E04F 17/00; E04F 15/02183; E04B 1/003; E04B 5/48; E04B 1/64; E04D 13/0477; E04D 13/0445; E04H 15/644; E04H 15/646

See application file for complete search history.

(56) References Cited

U.S. PATENT DOCUMENTS

| | | | |
|---|---|---|---|
| 2,986,150 | A | 5/1961 | Torian |
| 3,286,404 | A | 11/1966 | Harrison |
| 3,319,384 | A | 5/1967 | Berg |
| 3,667,174 | A | 6/1972 | Arnett |
| 4,065,883 | A | 1/1978 | Thibodeau |
| 4,571,897 | A | 2/1986 | Kerr |
| 4,583,331 | A | 4/1986 | Hunt |
| 4,663,894 | A | 5/1987 | LaRoche et al. |
| 4,742,654 | A | 5/1988 | Cole |
| 4,819,803 | A | 4/1989 | Neiser |
| 4,860,502 | A | 8/1989 | Mickelson |
| 4,878,322 | A | 11/1989 | Ikeda |
| 4,926,605 | A | 5/1990 | Milliken |
| 4,969,250 | A | 11/1990 | Hickman et al. |
| 4,976,074 | A | 12/1990 | Delamare |
| 5,125,713 | A | 6/1992 | Willingham |
| 5,155,952 | A | 10/1992 | Herwegh et al. |
| 5,358,757 | A | 10/1994 | Robinette et al. |
| 5,408,770 | A | 4/1995 | Suzuki |
| 5,752,297 | A | 5/1998 | Ramey |
| 5,765,328 | A | 6/1998 | Moore |
| 5,784,842 | A | 7/1998 | Wackerbauer |
| 5,882,062 | A | 3/1999 | Chenowith |
| 5,918,427 | A | 7/1999 | VanderWerf |
| 6,164,019 | A | 12/2000 | Salley |
| 6,209,271 | B1 | 4/2001 | Kovacs |
| 6,212,837 | B1 | 4/2001 | Davis et al. |

(Continued)

*Primary Examiner* — Gisele D Ford

(74) *Attorney, Agent, or Firm* — Merchant & Gould P.C.

(57) ABSTRACT

A deck drainage system includes a bracket, a locking bead, and a sheet. The bracket includes a first leg and an elongate receiver connected to an end portion of the leg. The elongate receiver defines a substantially round cross-sectional profile. The locking bead is an elongate member that defines a slit in an outer surface thereof for receiving the sheet. The locking bead is configured to be received in the receiver.

20 Claims, 10 Drawing Sheets

(56) References Cited

U.S. PATENT DOCUMENTS

| | | | |
|---|---|---|---|
| 6,226,941 | B1 | 5/2001 | Stevens |
| 6,244,007 | B1 | 6/2001 | Heikkila |
| 6,260,316 | B1 | 7/2001 | Davis et al. |
| 6,279,271 | B1 | 8/2001 | Burkart, Jr. |
| 6,314,684 | B1 | 11/2001 | Aviram |
| 6,343,450 | B1 | 2/2002 | Vance, Jr. |
| 6,393,785 | B1 | 5/2002 | Burt |
| 6,415,571 | B2 | 7/2002 | Risser |
| 6,421,967 | B1 | 7/2002 | Wlaker |
| 6,694,686 | B2 | 2/2004 | Ready |
| 6,904,720 | B1 | 6/2005 | Adolfson |
| 7,017,315 | B2 | 3/2006 | Corwin |
| 7,063,096 | B2 | 6/2006 | Stoeckler |
| 7,343,956 | B2 | 3/2008 | Schleef |
| 7,406,802 | B2 | 8/2008 | Stackenwalt |
| 7,736,092 | B2 | 6/2010 | Hodgekins et al. |
| 8,051,868 | B2 | 11/2011 | Whitlow |
| 8,146,315 | B2 | 4/2012 | Ruhlmann et al. |
| 8,250,821 | B1 | 8/2012 | Gibson |
| 8,327,565 | B2 | 12/2012 | Boltz |
| 8,627,624 | B2 | 1/2014 | Stockton |
| 8,851,096 | B2 | 10/2014 | De Villenfagne De Sorinnes |
| 8,893,417 | B2 | 11/2014 | Miller |
| 9,038,349 | B2 | 5/2015 | Fox |
| 9,353,532 | B2 | 5/2016 | Peterson et al. |
| 9,353,534 | B2 | 5/2016 | Peterson et al. |
| 9,422,732 | B2 | 8/2016 | Gower |
| 10,590,662 | B2 | 3/2020 | Peterson |
| 2001/0029706 | A1 | 10/2001 | Risser |
| 2003/0074850 | A1 | 4/2003 | Ready |
| 2004/0231260 | A1 | 11/2004 | Burkart |
| 2005/0035081 | A1 | 2/2005 | Fitch |
| 2005/0072081 | A1 | 4/2005 | Goebel |
| 2005/0217196 | A1 | 10/2005 | Fogg |
| 2005/0252151 | A1 | 11/2005 | Kindred |
| 2006/0048469 | A1 | 3/2006 | MacLean |
| 2006/0101730 | A1 | 5/2006 | Sprung |
| 2006/0219373 | A1 | 10/2006 | McKinney |
| 2006/0219374 | A1 | 10/2006 | McKinney |
| 2007/0039650 | A1 | 2/2007 | Huff |
| 2008/0000056 | A1 | 1/2008 | Murray |
| 2008/0142064 | A1 | 6/2008 | Maraki |
| 2008/0250734 | A1 | 10/2008 | Walker |
| 2009/0266018 | A1 | 10/2009 | Stockton |
| 2013/0233365 | A1 | 9/2013 | Loos |
| 2015/0033649 | A1 | 2/2015 | Peterson |
| 2015/0033650 | A1 | 2/2015 | Peterson |
| 2016/0236553 | A1 | 8/2016 | Stewart |
| 2018/0080236 | A1 | 3/2018 | Peterson |

DECK DRAINAGE SYSTEMS

CROSS-REFERENCE TO RELATED APPLICATIONS

This application is a continuation application of U.S. patent application Ser. No. 15/697,124 (now U.S. Pat. No. 10,590,662), entitled "DECK DRAINAGE SYSTEMS," filed on Sep. 6, 2017, which claims the benefit of U.S. Provisional Application Ser. No. 62/384,034, filed Sep. 6, 2016, the entire disclosures of which are hereby incorporated herein by reference in their entirety.

BACKGROUND

Outdoor decks or patios are often aligned vertically on the exterior of buildings (for example, apartment buildings) such that the deck of a lower unit is disposed below that of an upper unit. These outdoor decks are typically made of planks that span a number of joist members. When it rains, water falls through the planks of the deck and onto any decks located below. Thus, stacked exterior decks may not be desirable or useful during rainy conditions. Additionally, debris such as dirt, spilled food or beverages, or other items can fall through the planks from an upper deck to a lower deck and onto the occupants thereof. One solution is to attach waterproof sheathing material on the undersides of the joists to collect and redirect water and debris. This sheathing, however, is unsightly and can lower the perceived or actual clearance between the lower decks. Additionally, if the sheathing is not pitched properly, water may pool thereon. This pooling may lead to sheathing or joist degradation and rotting.

SUMMARY

In one aspect, the technology relates to a deck drainage system having: a bracket having: a first leg and an elongate receiver connected to an end portion of the leg, wherein the elongate receiver defines a substantially round cross-sectional profile; and a locking bead having an elongate member defining a slit in an outer surface of the elongate member; and a sheet having at least one edge configured to be disposed in the slit, wherein the locking bead is configured to be received in the receiver. In an example, the locking bead has a substantially round cross-sectional profile. In another example, the receiver cross-sectional profile has an inner diameter; and the locking bead cross-sectional profile has an outer diameter. In yet another example, the outer diameter is substantially similar to the inner diameter. In still another example, the outer diameter is greater than the inner diameter, and wherein the elongate receiver is configured to deflect when the locking bead is inserted into the elongate receiver.

In another example of the above aspect, the receiver cross-sectional profile includes an open mouth defined by a chord, the locking bead cross-sectional profile has an outer diameter greater than a length of the chord. In an example, the locking bead is configured to be received in the mouth. In another example, the deck drainage system has a tab extending from at least one of the receiver and the leg. In yet another example, the sheet includes a barb configured to resist removal of the at least one edge from the slit.

In another aspect, the technology relates to a drainage system having: an elongate bracket having a substantially C-shaped receiver; a locking bead configured to be received in the receiver, wherein the locking bead includes an exterior surface at least partially defining a slit; and a sheet material having an edge configured to be received in the slit. In an example, the locking bead is elongate. In another example, the locking bead is substantially hollow and has a substantially rigid outer wall. In yet another example, the locking bead is solid and wherein the slit is defined by the locking bead to a predetermined depth. In still another example, the elongate bracket defines an opening for receiving a fastener.

In another example of the above aspect, the elongate bracket further includes an elongate leg disposed substantially tangential to the substantially C-shaped receiver. In an example, the elongate leg defines the opening. In another example, the bracket further includes: an elongate leg disposed substantially tangential to the substantially C-shaped receiver; and a tab extending from the substantially C-shaped receiver at an angle to the elongate leg. In yet another example, the angle is approximately 90 degrees. In still another example, the tab is flexible. In another example, the exterior surface of the locking bead has a diameter greater than a chord length of a mouth of the substantially C-shaped receiver.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

DETAILED DESCRIPTION

The technologies described herein may be utilized in retrofit applications on existing decks, as well as on newly-constructed decks. Additionally, while the most common types of decks in residential construction are those utilizing wood joists and wood or wood-plastic composite decking, the systems and methods described herein may be utilized on decks manufactured of metal with few, if any, required modifications. Deck drainage systems are described in U.S. Pat. Nos. 9,353,532 and 9,353,534, the disclosures of which are hereby incorporated by reference herein in their entireties. The deck drainage systems described herein improve even further upon the technologies described in the above-identified patents.

Figure 1:
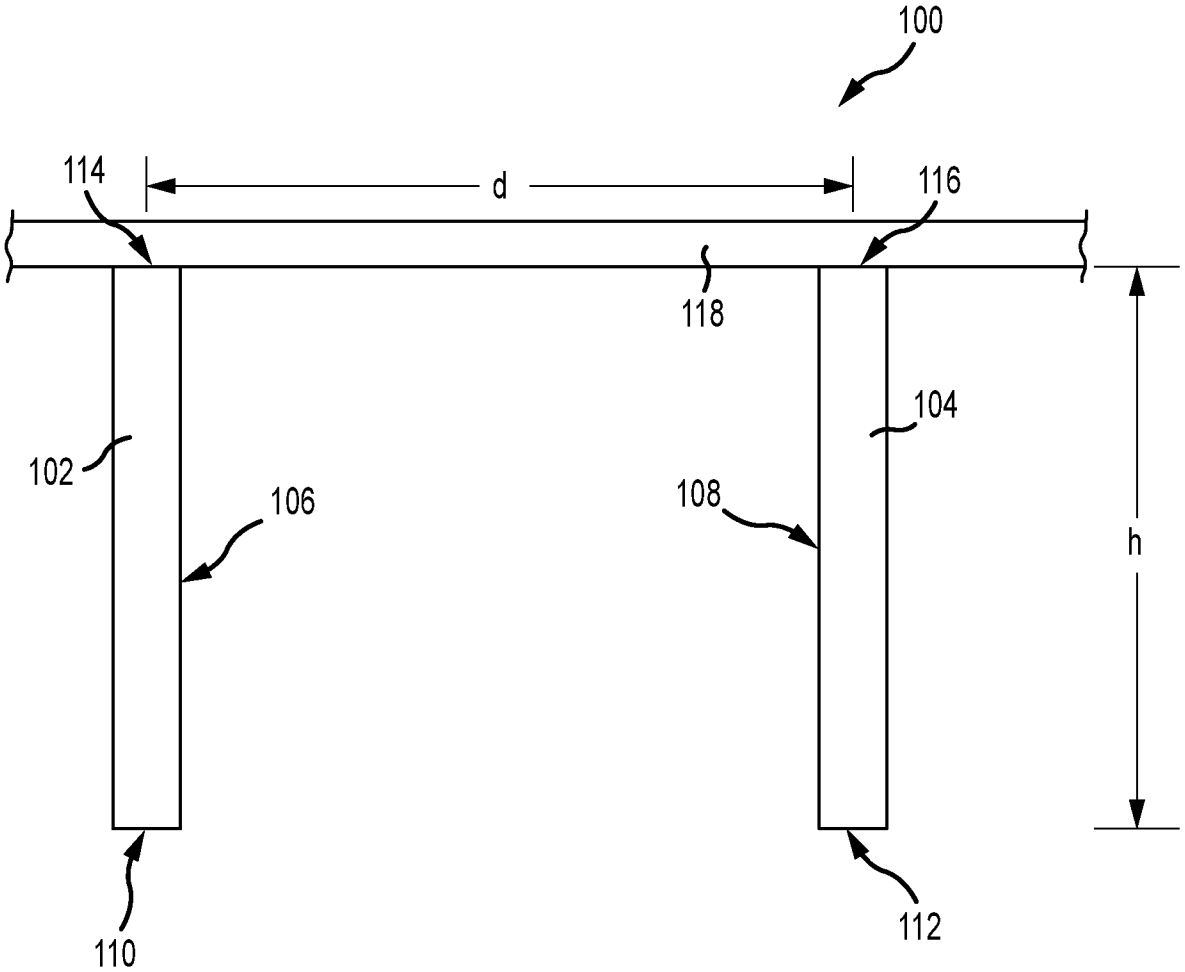
FIG. 1 is a partial end view of a deck.

An example of a deck 100 is depicted in FIG. 1. The support structure of the deck 100 includes joists 102, 104, typically installed with a center-to-center distance d of about 16 inches or about 12 inches. Of course, other distances may be utilized. The height h of each joist may be as required or desired for a particular application based on the materials selected. The joists 102, 104 have opposing side surfaces 106, 108, bottom surfaces 110, 112, and upper surfaces 114, 116. A plank structure 118 spans the plurality of joists 102, 104.

Figure 2A:
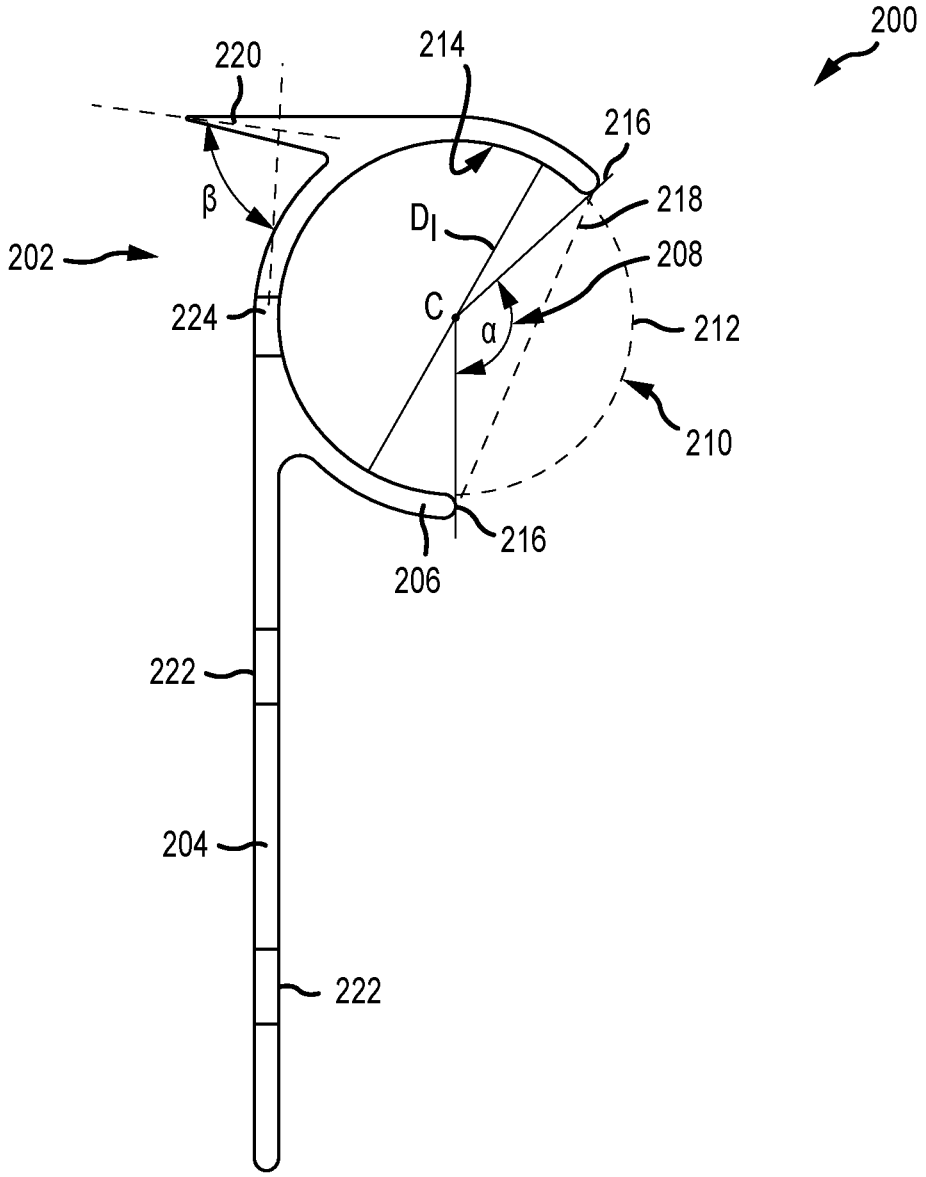
FIG. 2A is an end view of an elongate bracket utilized in a deck drainage system.

FIG. 2A is an end view of an elongate bracket 200 utilized in a deck drainage system. The bracket 200 is formed of an elongate body 202 having a defined cross-sectional profile, such as depicted in FIG. 2A. The body 202 includes a leg 204 that extends generally downward from a receiver 206. The receiver 206 is a substantially C-shaped element that defines an inner void 208. In examples, the receiver 206 has a substantially round cross-sectional profile. As such, the leg 204 may extend substantially tangentially from the receiver 206. The inner void 208 is configured to receive an elongate locking bead (FIG. 2B), which is inserted therein via a mouth 210, such as described below. The mouth 210 is depicted with a curvature 212 identical to that of an interior surface 214 of the receiver 206. The mouth 210 may be defined by an aperture angle $\alpha$ formed by the terminal ends 216 of the receiver 206 and a center C of a circle that defines the void 208. This aperture angle $\alpha$ may be dimensioned as required or desired for a particular application. For example, the angle may be about 90°, about 115°, about 135°, or greater. Aperture angles $\alpha$ less than 90° are also contemplated.

The interior surface 214 may have a curvature that approximates a circle having a center C. As such, the interior surface 214 may correspond to a major arc of that circle defined by center C, while the mouth 210 may correspond to a minor arc thereof. In general, the length of the mouth 210 would be shorter than a length of the interior surface 214. Additionally, the mouth 210 may be defined by a chord 218, which in certain examples is shorter than a diameter $D_I$ of the circle. This configuration allows the receiver mouth 210 to easily accommodate the elongate locking bead (FIG. 2B), without permanent deformation of the receiver 206, as described in more detail below. The body 202 may also include a tab 220 extending from an upper portion thereof, generally proximate the receiver 206. The tab 220 may be flexible and, when in a relaxed state, may be disposed at an angle $\beta$ to the leg 204. In the depicted example, the angle $\beta$ may be about 90 degrees, although other angles are contemplated. The leg 204 may define one or openings 222 for receiving a fastener such as a screw or a nail. In other examples, such as examples when the bracket 200 does not include an elongate leg 222, an opening 224 may be defined by the receiver 206 itself.

To limit degradation when exposed to extremes of temperature and the elements, the bracket is typically formed of extruded materials, such as PVC, HDPE, LDPE, rubber, and other types of plastics or otherwise resilient materials. The tab may be extruded of the same material as the leg and receiver and, in examples, the extrusion may be continuous and cut after formation into manageable lengths. The bracket may be further field cut prior to installation. Alternatively, for reasons described in more detail below, it may be desirable to utilize a highly flexible material for the tab. Such a material may be coextruded with the main portion of the body so as to form a unitary part. Such material may include FPVC, TEKNOR, APEX, or other highly flexible material. Additionally, depending on the application, all or part of the bracket may be manufactured of robust but somewhat flexible metals such as steel, aluminum, or stainless steel. These metals may be coated with plastic or sprayed with coatings or layers to prevent corrosion and increase durability.

Figure 2B:
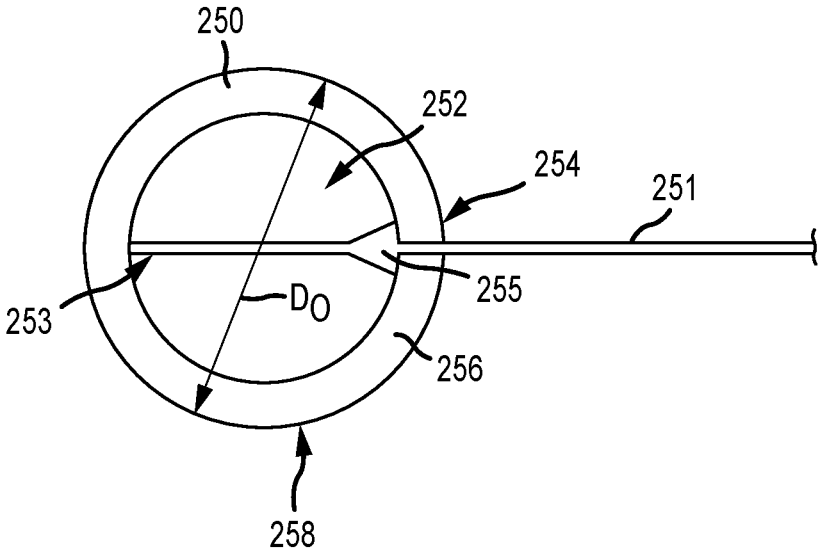
FIG. 2B is a partial end view of a sheet and an elongate locking bead utilized in a deck drainage system.

FIG. 2B is a partial end view of a sheet element 251 (described in more detail below) and an elongate locking bead 250 utilized in a deck drainage system. The locking bead 250 is an elongate element such as one-half inch OD PVC pipe, although other materials may also be utilized. In the case of pipe, the locking bead 200 has a substantially round cross-sectional profile. For example, the elongate element may be manufactured of materials similar to that of the bracket 200. If PVC or other pipe is used, the locking bead 250 defines an interior void 252 (i.e., the lumen of the pipe). In other examples, the locking bead 250 may instead be solid. A slit 254 is formed lengthwise in a wall 256 of the elongate locking bead 250 and is configured to receive an edge 253, typically one of the trapezoidal edges, of the sheet 251. In cases where a solid locking bead is utilized, the slit 254 may penetrate into the interior of the elongate locking bead to a desired depth. The sheet 251 may be secured to the elongate locking bead 250 with an adhesive, e.g, at the slit 254 or closer to the edge 253 of the sheet 251. In another example, the interior 252 of the elongate locking bead 250 may be filled or partially filled with an adhesive. In examples, however, the thin width of the slit 254 may be sufficient to retain the sheet 300 therein without resorting to adhesives. In another example, a barb 255 may be formed proximate the edge 253 of the sheet 251. The barb 255 may have a tapered shape that resists removal of the sheet 251 from the locking bead 250 once inserted therein. The wall 256 of the elongate locking bead 250 includes an outer surface 258 having a diameter $D_O$. The diameter $D_O$ may be substantially similar to the inner diameter $D_I$ of the receiver 206. In another example, the diameter $D_O$ may be sized such that, when inserted into the mouth 210 of the receiver 206, the ends 216 of the receiver deflect to receive the locking bead 250. In another example, a length of the chord 218 may be less than the diameter $D_O$ of the locking bead 250. In another example, the diameter $D_O$ may be greater than the inner diameter $D_I$, such that the ends 216 remain deflected outward when the locking bead 250 is inserted into the receiver 206.

Figure 3:
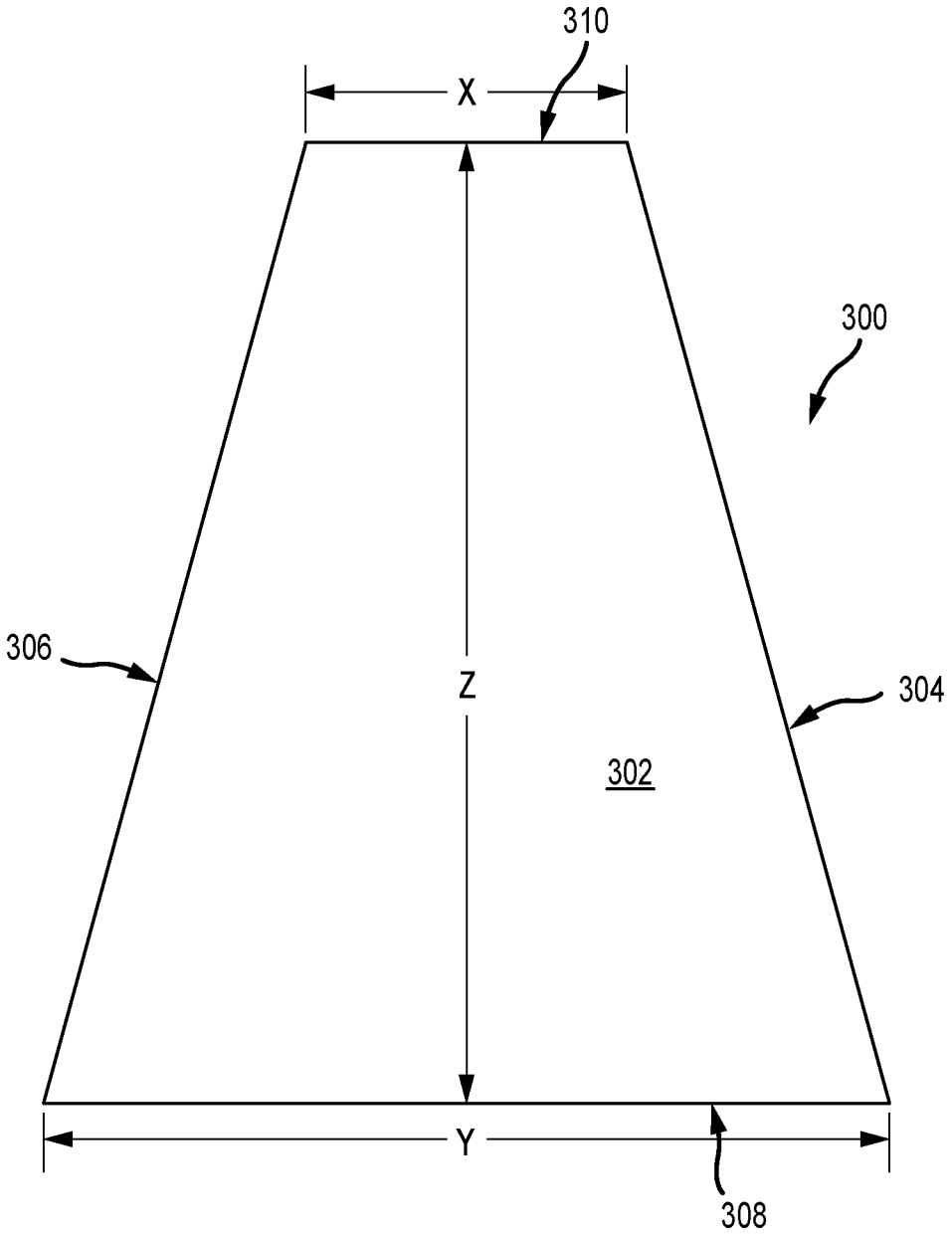
FIG. 3 is a top view of a deck drainage sheet.

FIG. 3 depicts a sheet element 300 that is configured to span a pair of brackets in a deck drainage system. The sheet 300 is a thin, flexible material, typically plastic such as extruded HDPE, polyethelene, or other resilient material. Additionally, the sheet may be manufactured of the same material as the bracket. Materials that resist degradation, mold growth, and/or tearing may be utilized in certain embodiments. Coated metals or plywood may also be utilized. In certain embodiments, the sheet need only be about 1/16 inch nominal thickness, although other thicknesses are contemplated. Additionally, materials having a smooth upper surface 302 to promote proper drainage may be utilized. Rectangular or trapezoidal sheets 300 (as depicted in FIG. 3) may be utilized in the systems described herein. Trapezoidal sheets are manufactured such that the edges 304, 306 taper towards each other from a wide end 308 to a narrow end 310. Trapezoidal sheets 300 have certain advantages, in that the edges 304, 306 may be inserted into opposing brackets that have been installed level on sides of opposing joists, thus forming a sag or trough along a central portion of the sheet 300. Due to the trapezoidal shape, the sag increases along the length of the sheet 300. This is described in more detail below. For decks having joists about 12 inches on-center, a width x of the narrow end 310 may be about 10 inches may be utilized. For decks having joists about 16 inches on-center, the width x of the narrow end 310 may be about 14 inches. The length z may vary depending on the length of the deck joists. The pitch of this increasing sag or trough may be dictated at least in part by the width y of the wide end 308 of the sheet 300. Sheets that have larger differences between width x and width y will display greater pitch once installed.

Figure 4:
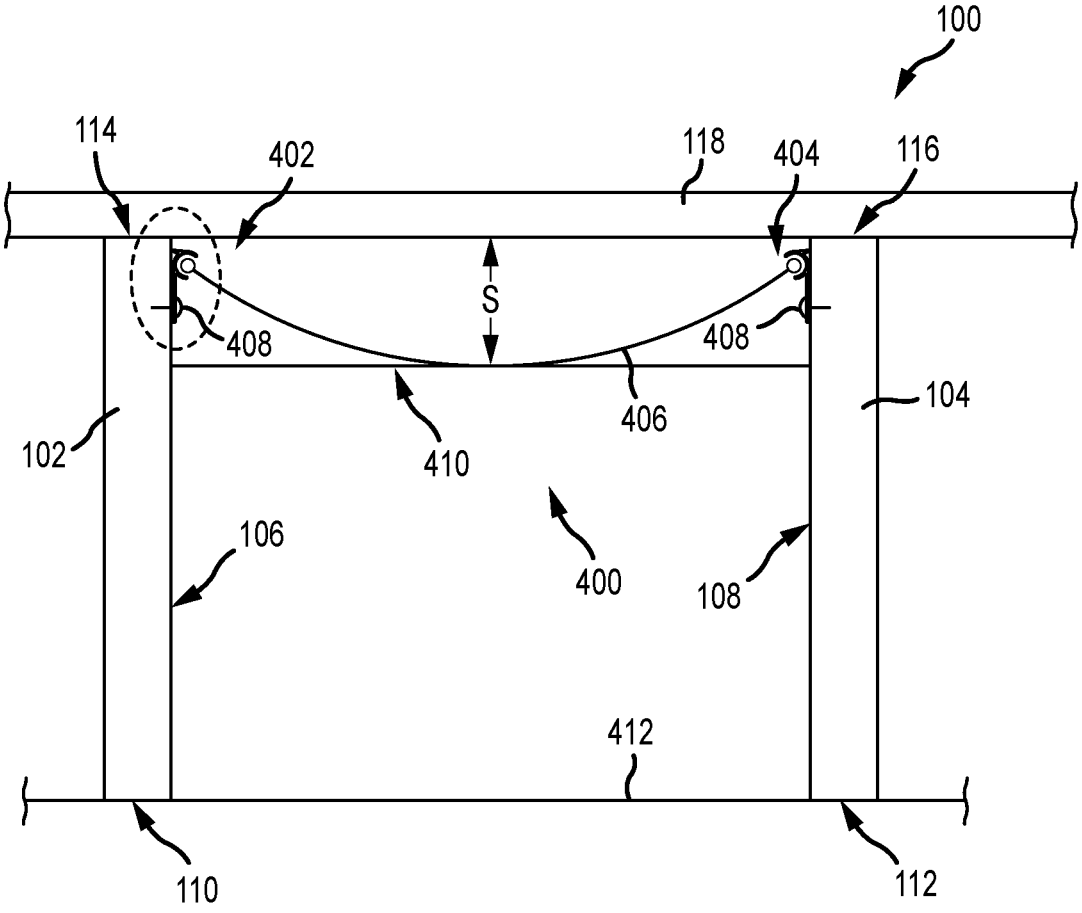
FIG. 4 is a partial end view of a deck utilizing a deck drainage system.

An example of a deck 100 with a deck drainage system 400 is depicted in FIG. 4. As described above with regard to FIG. 1, the support structure of the deck 100 includes joists 102, 104, typically installed on with a center-to-center distance d of about 16 inches or about 12 inches. Of course, other distances d may be utilized. The height h of each joist may be as required or desired for a particular application based on the materials selected. The joists 102, 104 have opposing side surfaces 106, 108, bottom surfaces 110, 112, and top surfaces 114, 116. The drainage system 400 includes at least two brackets 402, 404, such as described herein. The bracket 402 is installed such that the rear surface thereof abuts the side surface 106 of the joist 102. The bracket 404 is similarly installed against the opposing joist 104. The brackets 402, 404 are installed such that the tab at the upper portion thereof is in contact with the undersides of the plank structure 118. Advantages of this installation configuration are described in further detail below.

A sheet 406 spans the brackets 402, 404 and is held in the receiver of the brackets 402, 404 due to presence of the locking bead. Thus, the flexible nature of the sheet 406 forces the brackets 402, 404 away from each other and into the joists 102, 104. This force may be sufficient to hold the brackets 402, 404 in place against the opposing side surfaces 106, 108 of the joists 102, 104. Fasteners 408 may also be used to further secure the brackets 402, 404. Thus, the sheet 406 forms an increasing sag or trough a distance S below the deck structure 118. This distance S increases along the length of the joists 102, 104. Adhesives may be used to further secure the sheet 406 to the brackets 402, 404, but are not required.

For longer deck drain systems 400, the weight of the sheet 406 may be such that additional support thereof may be desirable to help prevent the sheet 406 from pulling free from the brackets 402, 404. As such, one or more braces 410 may be installed at predetermined spacing intervals. Braces 410, if used, are generally installed against the bottom of the sheet 406, for example, at three foot intervals. The braces need not be rigid. For example, straps similar to those utilized to hang piping may be used, or the brace may be manufactured of the same material as the sheet member. For aesthetic purposes, a screen, plate, or other material 412 may be installed against the bottom surfaces 110, 112 of the joists 102, 104. This material 412 limits the visibility of the deck drainage system 400 from below. Although any type of material 412 may be used, a screen or perforated material may be desirable in certain embodiments to promote airflow between the joists 102, 104. The material may be colored to match the building architecture or may be printed with a pattern or painted.

Figure 5A:
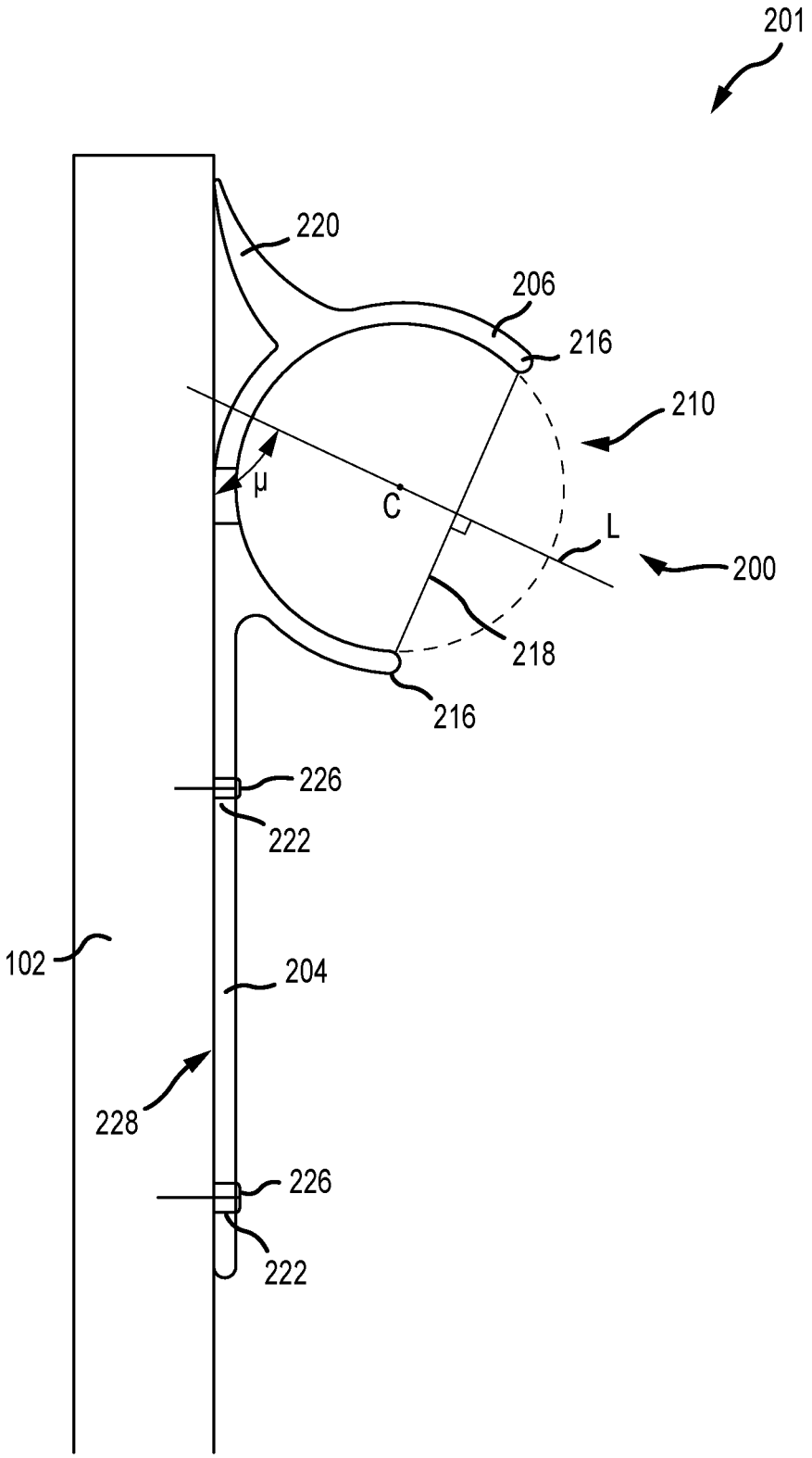
FIGS. 5A-5C depict a partial end view of a deck drainage system during installation.
Figure 5B:
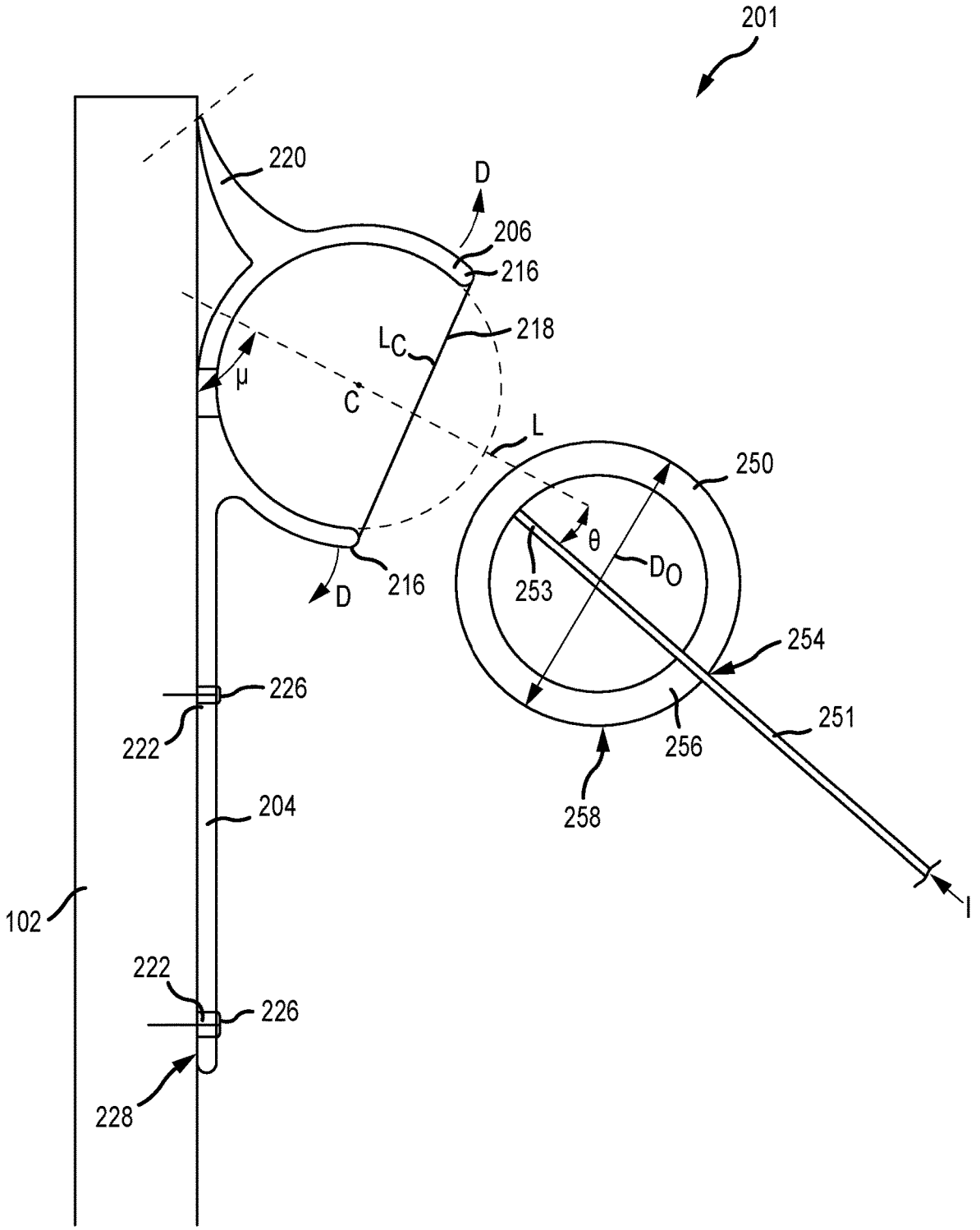
Figure 5C:
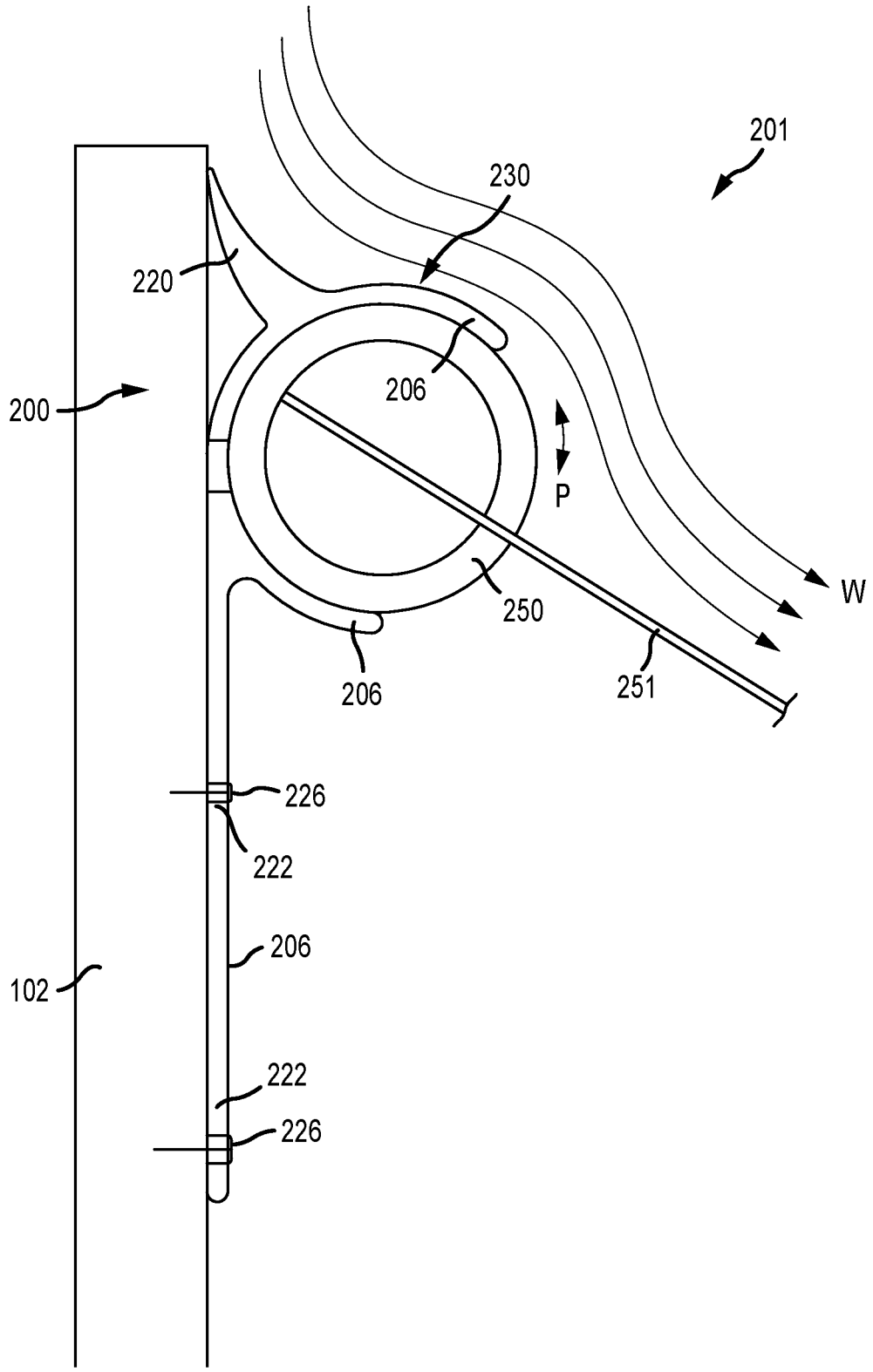

FIGS. 5A-5C depict a partial end view of a deck drainage system 201 during installation and are generally described concurrently. A structure 102, such as a deck joist, is depicted. In FIG. 5A, a bracket 200 is secured to the structure 102 with one or more fasteners 226, which may be nails, screws, staples or other mechanical fasteners inserted through one or more openings 222. In another example, an adhesive may be alternatively or additionally utilized, e.g., on a surface 228 of the leg 204 facing the structure 102. A tab 220 may be deflected so as to face upward along the structure 102. A similar fastener may be installed on a facing structure (e.g., an adjacent joist). Two ends 216 of a receiver 206 define a mouth 210 thereof.

The size of the mouth 210 is defined by a chord 218 defined substantially by the two ends 216. The position of the two ends 216 relative to a center C of the receiver 206 may characterize an orientation of the mouth 210, which can effect performance of the system 201. For example, a line L passing through the center C and intersecting the chord 218 at a substantially orthogonal angle also passes through the structure 201. Since the structure 201 is substantially parallel to the leg 204, the line L effectively forms an angle μ relative to the leg 204. This angle μ may be called the mouth angle μ. It has been discovered that drainage performance and efficiency of the system 201 is acceptable when the mouth angle μ is less than about 90 degrees from the leg 204. In other examples, the mouth angle μ may be between about 30 and about 80 degrees, between about 40 and about 70 degrees, and between about 50 and about 60 degrees. Mouth angles of less than about 30 degrees may make installation of the sheet (depicted in FIG. 5B more difficult, while angles closer to about 90 degrees may have a detrimental effect on drainage performance and efficiency.

FIG. 5B depicts the bracket 201 secured to the structure 102. The edge 253 of the sheet 251 is first inserted into the slot 254 of the locking bead 250. In examples, the length of the locking bead 250 may be substantially the same as the length of the bracket 200 (which is generally field cut to the length of the structure 201 against which the bracket 200 is installed). In another example, the locking bead 250 may be multiple discrete locking beads, which may be less than the total length of the bracket 200. For example, each locking bead in such a case may be between about two inches to about six inches long and may be installed at regular or semi-regular distances apart on the edge 253 of the sheet 251. Such a configuration may ease insertion I of the locking bead into the bracket 200. Regardless of the locking bead 250, once the edge 253 is inserted into the slot 254 to the appropriate depth, the locking bead 250 is inserted I into the mouth 210 of the receiver 206. The chord length $L_C$, is generally shorter than the outer diameter $D_O$ of the locking bead 250. As such, contact between the locking bead 250 and the ends 216 of the receiver 206 causes outward deflection D of the ends 216. Once the locking bead 250 is inserted past the outer diameter $D_O$ thereof, the ends 216 of the receiver 206 return toward their original position, thus holding the locking bead 250 in place. It is noted that insertion I need not be on the line L that defines the mouth angle μ. Indeed, in the field during insertion I, the sheet angle θ (that is the angle between the line L and the sheet 251) may vary depending on the distance between adjacent joist structures, width of the sheet 251, installer preference, etc.

In FIG. 5C, the configuration of the installed system 201 is depicted. The natural bias of the sheet 251 when installed may cause the locking bead 250 to pivot P within the receiver 206 until a balanced condition is reached. Thus the sheet angle θ may vary along the length of the bracket. Once installed, due to the position of the tab 220, water W may be deflected from the structure 102, down the tab 220, along an outer surface 230 of the receiver 206, around the locking bead 250, and onto the sheet 251, where it drains away. Thus, the space below the sheet 251 remains dry.

Figure 6:
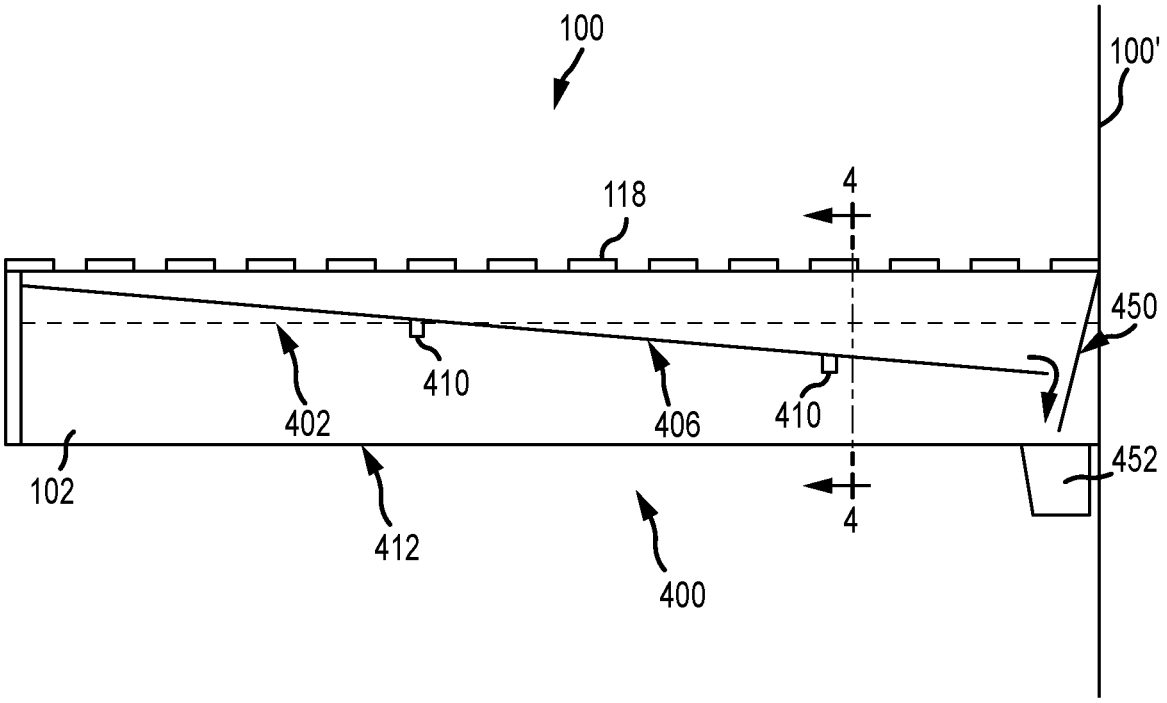
FIG. 6 is a partial side view of a deck utilizing a deck drainage system.

FIG. 6 depicts a partial side view of a deck 100 extending from a building 100' and utilizing a drainage system 400. As depicted above, plank structure 118 spans a top of a plurality of joists, although only one joist 102 is depicted in FIG. 6. The bottom of a bracket 402 is depicted by a dotted line, for clarity. As described above, the bracket 402 is installed abutting the plank structure 118 so as to limit exposure of the joist 102 to the elements. The sheet 406 is depicted by a line, the pitch of which is exaggerated for illustrative purposes. In practice, the pitch of the sheet may be about 1 inch per 10 feet of travel. Other pitches to expedite draining are contemplated. Steeper pitches may be desirable in locales where freezing of slowly moving water is likely. Braces 410 are included to provide additional support to the sheet 406.

In the depicted system 400, the sheet 406 drains water towards the building 100'. A deflector 450, made from the same material as the sheet 406 and bowed outward from the building 100', prevents the water from contacting the building 100', slows the flow of water, and deflects the water into a gutter 452, as depicted by the arrow. The gutter 452 may then be routed to a building downspout, either new or existing, for removal from the building 100'. Of course, the deck drainage system may also be pitched away from the building 100', as required or desired for a particular application.

Figure 7:
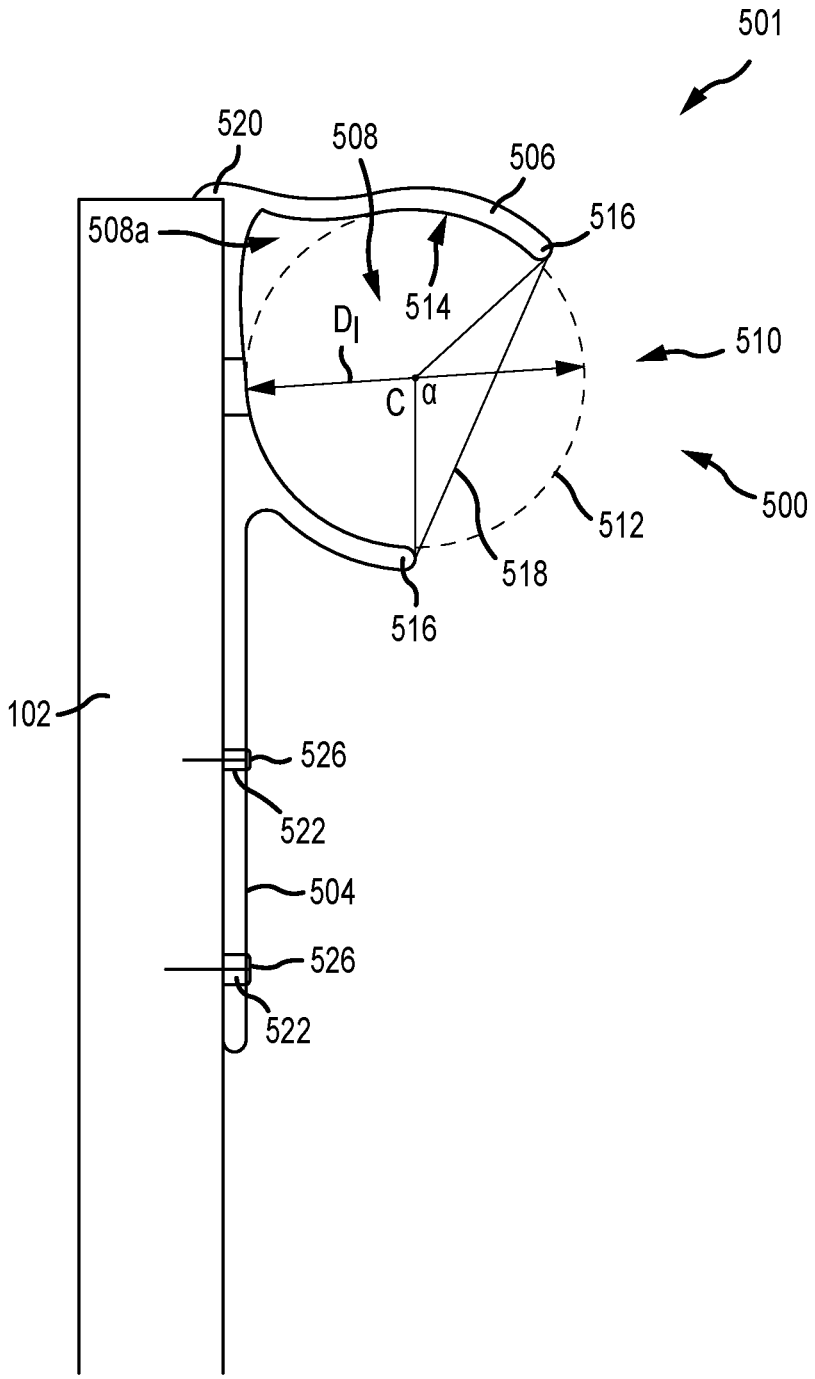
FIG. 7 is an end view of another elongate bracket utilized in a deck drainage system.

FIG. 7 is an end view of another example of an elongate bracket 500 utilized in a deck drainage system 501. The elongate bracket 500 may be utilized with the locking bead and sheet such as described elsewhere herein. The bracket 500 is formed of an elongate body 502 having a defined cross-sectional profile. The body 502 includes a leg 504 that extends generally downward from a receiver 506. The receiver 506 is a substantially C-shaped element that defines an inner void 508. Unlike the example brackets depicted above, the bracket 500 depicted in FIG. 7 does not have a round cross-sectional profile. Instead, the void 508 may include an excess void 508*a*. The excess void 508*a* may define a volume into which the round cross sectional profile of the locking bead (depicted as curved dotted line 512) does not enter when inserted into the receiver 506. The inner void 508 is configured to receive an elongate locking bead (as depicted above), which is inserted therein via a mouth 510, such as described elsewhere herein. The mouth 510 is depicted with a curvature 512 identical to that of a portion of an interior surface 514 of the receiver 506. The mouth 510 may be defined by an aperture angle $\alpha$ formed by the terminal ends 516 of the receiver 506 and a center C of a circle that defines the void 508. This aperture angle $\alpha$ may be dimensioned as required or desired for a particular application. For example, the angle may be about 90°, about 110°, about 115°, about 135°, or greater. Aperture angles $\alpha$ less than 90° are also contemplated.

The interior surface 514 may have a curvature in along certain portions thereof that approximates a circle having a center C. As with the examples above, the mouth 510 may be defined by a chord 518, which in certain examples is shorter than a diameter $D_I$ of the circle, which is in this case defined by the outer diameter $D_O$ of the elongate locking bead (not shown) disposed therein. This may again allow for deflection of the receiver 506 without permanent deformation thereof, as described in more detail herein. The body 502 may also include a tab 520 extending from an upper portion thereof, generally proximate the receiver 506. The tab 520 may be configured to conform to a top corner and upper surface of a structure 102, such as a joist. This may ease installation and help divert water away from the structure 102. The leg 504 may define one or openings 522 for receiving a fastener 526 such as a screw or a nail. The elongate bracket 500 depicted in FIG. 7 may also be characterized by a mouth angle $\mu$, defined above, but not depicted in FIG. 7. Installation and assembly of the drainage system 501 (including the elongate bracket 500, locking bead, and sheet) is similar to that described above. It is noted that insertion I of the locking bead and sheet into the receiver 506 need not be on the line L (defined above) that defines the mouth angle $\mu$. Indeed, in the field during insertion I, the sheet angle $\theta$ (that is the angle between the line L and the sheet) may vary as required or desired for a particular application.

The deck drainage systems described herein may be sold as a kit, either in a single package or in multiple packages. A kit may include a sheet, one or more brackets, one or more locking beads, braces, deflectors, screens, or each of these components may be sold separately. If desired, fasteners and gutters may be included, although instructions included with the kit may also specify the types of these components recommended, based on the particular installation. In certain embodiments, the bracket and/or locking bead may be sold as single extruded pieces that may be field-cut into multiple pieces. Similarly, the sheet material may be field-cut to a desired length. The screen material may also be modifiable. Adhesive glues for securing the brackets to joists may also be included in the kit or acceptable types may be identified in the instructions.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. A deck drainage system comprising:

a bracket comprising:

a leg, an elongate receiver connected to an end portion of the leg, and a tab extending from at least one of the elongate receiver and the leg, wherein the elongate receiver defines a cross-sectional profile comprising a first inner surface and a second inner surface separated from the first inner surface, and wherein the elongate receiver defines an open mouth defined by a chord and a line disposed substantially orthogonal to the chord, and wherein the leg is disposed on a first side of the line and the tab is disposed on a second side of the line;

a locking bead comprising an elongate member defining a slit in an outer surface of the elongate member, wherein the elongate member is configured to be received in the elongate receiver via the mouth, and contact the first inner surface and the second inner surface, and wherein the elongate member and the elongate receiver together define an excess void where the elongate member does not contact the elongate receiver; and a sheet having at least one edge configured to be disposed in the slit.

2. The deck drainage system of claim 1, wherein the elongate member comprises a substantially round cross-sectional profile.

3. The deck drainage system of claim 2, wherein:

the receiver cross-sectional profile comprises an inner diameter; and the locking bead cross-sectional profile comprises an outer diameter.

4. The deck drainage system of claim 3, wherein the outer diameter is substantially similar to the inner diameter.

5. The deck drainage system of claim 3, wherein the outer diameter is greater than the inner diameter, and wherein the elongate receiver is configured to deflect when the locking bead is inserted into the elongate receiver.

6. The deck drainage system of claim 2, wherein the locking bead cross-sectional profile comprises an outer diameter greater than a length of the chord.

7. The deck drainage system of claim 6, wherein the locking bead is configured to be received in the mouth.

8. The deck drainage system of claim 1, wherein the sheet comprises a barb configured to resist removal of the at least one edge from the slit.

9. The deck drainage system of claim 1, wherein the first inner surface is curved.

10. A deck drainage system comprising:

an elongate bracket comprising a receiver at least partially defining a void and an excess void, wherein the receiver defines an open mouth defined by a chord and a line disposed substantially orthogonal to the chord;

a locking bead configured to be received in the void of the receiver but not the excess void of the receiver, wherein the locking bead comprises an exterior surface at least partially defining a slit;

a tab extending from the elongate bracket on a first side of the line;

a leg extending from the elongate bracket on a second side of the line; and a sheet material comprising an edge configured to be received in the slit.

11. The deck drainage system of claim 10, wherein the locking bead is elongate.

12. The deck drainage system of claim 10, wherein the locking bead is substantially hollow and comprises a substantially rigid outer wall.

13. The deck drainage system of claim 10, wherein the elongate bracket defines an opening for receiving a fastener.

14. The deck drainage system of claim 13, wherein the leg is disposed substantially tangential to the receiver.

15. The deck drainage system of claim 14, wherein the leg defines the opening.

16. The deck drainage system of claim 10, wherein the bracket further comprises:

an elongate leg disposed substantially tangential to the receiver; and wherein the tab extends from the receiver at an angle to the leg.

17. The deck drainage system of claim 16, wherein the angle is approximately 90 degrees.

18. The deck drainage system of claim 16, wherein the tab is flexible.

19. The deck drainage system of claim 10, wherein the exterior surface of the locking bead comprises a diameter greater than a chord length of a mouth of the receiver.

20. The deck drainage system of claim 9, wherein the second inner surface is curved.

* * * * *